US005893400A

United States Patent [19]

Harvey

[11] Patent Number: 5,893,400

[45] Date of Patent: Apr. 13, 1999

[54] DEBARKER HEAD ASSEMBLY

[76] Inventor: Tyler Harvey, P.O. Box 272, Tylertown, Miss. 39667

[21] Appl. No.: 08/989,335

[22] Filed: Dec. 11, 1997

[51] Int. Cl.[6] ..... B27L 1/00

[52] U.S. Cl. ..... 144/208.4; 144/219; 144/228; 144/241; 407/34; 407/42; 407/59; 299/39.4; 299/39.6

[58] Field of Search ..... 144/208.1, 208.4, 144/208.5, 208.6, 218, 228, 241; 299/39.4, 39.6; 407/34, 42, 59, 31, 58

[56] References Cited

U.S. PATENT DOCUMENTS

| | | | |
|---|---|---|---|
| 1,337,286 | 4/1920 | Stadig | 144/208.5 |
| 2,034,908 | 3/1936 | Kirkwood | 144/208.6 |
| 2,695,194 | 11/1954 | Hartwig | 144/208.4 |
| 2,950,743 | 8/1960 | Napier et al. | 144/208.4 |
| 3,176,734 | 4/1965 | Broadbent | 144/208.6 |
| 3,416,581 | 12/1968 | Parrish et al. | 144/208.4 |
| 3,451,450 | 6/1969 | Morey et al. | 144/340 |
| 3,724,900 | 4/1973 | Hatcher et al. | 299/39.6 |
| 3,779,607 | 12/1973 | Staab | 299/39.6 |
| 4,562,873 | 1/1986 | Kröcher et al. | 144/208.6 |
| 5,070,919 | 12/1991 | Ackerman | 144/208 |
| 5,168,907 | 12/1992 | Herrington et al. | 144/208.4 |
| 5,201,353 | 4/1993 | Weill | 144/236 |

*Primary Examiner*—W. Donald Bray

*Attorney, Agent, or Firm*—Garvey, Smith, Nehrbass & Doody, LLC

[57] ABSTRACT

An improved debarking apparatus, which includes a substantially, cylindrically shaped debarker head having a plurality of cutting blades to form its out peripheral surface, the debarker head mounted on a central shaft so that it may rotate freely on the shaft during the debarking process. In a first embodiment, the improved assembly would incorporate a pair of depth control bearing collars, mountable on an existing pillow block bearing, the bearing collar incorporating an adjustable shoe which includes an arcuate lower surface for making contact with the bark of the log that is being debarked, so as to select the precise depth of cut into the bark by the cutting blades of the debarker head. A second embodiment would provide a depth control bearing assembly which would be utilized in place of the pillow block bearing, the assembly including a roller bearing insert on each end of the debarker head, with the insert engaged upon the rotatable shaft, for accommodating a depth control bearing on the insert, with the depth control bearing likewise incorporating an adjustable shoe member on the lower portion of each of the bearing housings, the adjustable shoe including the arcuate lower surface for making contact with the bark of the log that is being debarked. The adjustable shoe would include an upper main body portion, having a pair of elongated slots therein so as to accommodate a pair of mounting screws between the adjustable shoe and the bearing collar.

17 Claims, 4 Drawing Sheets

DEBARKER HEAD ASSEMBLY

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present, invention relates to debarking apparatus. More particularly, the present invention relates to an improved debarking head assembly which incorporates a depth controlled bearing assembly having adjustable shoes which are mountable on existing debarking apparatuses and would allow a precise depth of cut adjustment for controlling the amount of wood or bark removed from a log during the debarking process.

2. General Background of the Invention

In the present state of the art, in the initial stages of the production of finished wood, the trees which are felled must be stripped of the bark, preferably at the site of the logging operation. The trees are then transported to processing at a sawmill. In the process for stripping the bark from a felled tree, the bark is initially removed through what is termed a debarking process which may commonly occur at a sawmill. A typical debarking apparatus would include a rotating debarker head which is positioned above the log while the log is rotated under the debarker apparatus. The debarker head rotates at an extremely high speed, and through a plurality of teeth or cutting knives, the knives make contact with the log as it is slowly rotated adjacent the debarking head, and the bark is literally stripped from the log through cutting and chipping. Usually there is a specific arrangement of the cutting knife which may affect how effective the debarking process is. However, it is often difficult in the present state of the art to control the precise depth at which the cutting knives will cut into the tree thus resulting, often times, in a significant loss of valuable wood rather than only a loss of the bark around the tree trunk.

Of course, the debarker head with the knives or cutting blades are usually rotated around a central shaft, with the shaft being positioned on a pair of end mounting bearings which are normally called pillow block bearings which would normally absorb the shock that would result from the blades making contact with the bark during operation, but would not have the ability to measure the depth of the cut. Therefore, there is a significant need in the industry for precisely controlling the depth of the cut that the blades on a debarker apparatus make into the bark of a tree trunk, so as to avoid loss of valuable wood during the process, without the need of additional other devices such as pivoted arms, rollers, or hydraulic cylinders moved in an effort to raise the debarker head, which are found to be ineffective. Reference is made to U.S. Pat. No. 5,168,907 which discloses a debarker apparatus, manufactured by Tyler Tool Co.

BRIEF SUMMARY OF THE INVENTION

The apparatus of the present invention solves the problems in the art in a simple and straight forward manner. What is provided is an improved debarking apparatus, which includes a substantially, cylindrically shaped debarker head having a plurality of cutting blades to form its outer peripheral surface, the debarker head mounted on a central shaft so that it may rotate freely on the shaft during the debarking process. In a first embodiment, the improved assembly would incorporate a pair of depth control bearing collars, mountable on an existing pillow block bearing, each bearing collar incorporating an adjustable shoe which includes an arcuate lower surface for making contact with the bark of the log that is being debarked, so as to select the precise depth of cut into the bark by the cutting blades of the debarker head. A second embodiment would provide a depth control bearing assembly which would be utilized in place of the pillow block bearing, the assembly including a roller bearing insert on each end of the debarker head, with the insert engaged upon the rotatable shaft, for accommodating a depth control bearing on the insert, with the depth control bearing likewise incorporating an adjustable shoe member on the lower portion of each of the bearing housings, the adjustable shoe including the arcuate lower surface for making contact with the bark of the log that is being debarked. In both embodiments, the adjustable shoe would include an upper main body portion, having a pair of elongated slots therein so as to accommodate a pair of mounting screws between the adjustable shoe and the bearing collar, the adjustable shoe providing for adjusting the location of the depth position of the shoe relative to the depth of the cutting head of the debarker apparatus, so that the adjustable shoes may be positioned to make contact with the bark of the log at a precise depth, so that when the cutters of the debarker head make contact with the bark, there can be a precise setting of the depth of the cut based upon the position of the adjustable shoes on either end of the rotating debarker head.

Therefore, it is the principal object of the present invention to provide an improved debarking apparatus which allows for the precise depth of a cut adjustment which controls the amount of wood or bark being removed from a log;

It is a further object of the present invention to provide an improved debarking apparatus which would minimize the amount of wood fiber lost during the debarking process, and would provide for a smooth debarker operation;

It is a further object of the present invention to provide in a first embodiment a depth control bearing collar which is positionable on existing pillow block bearings, for use on existing debarker assembly heads, having an adjustable shoe that provides for a precise cut into the bark by the blades on the rotatable debarkable head;

It is a further object of the present invention to provide an improved debarker head having depth control bearings which are utilized in place of existing pillow block bearings, and provides for adjustability between the depth control bearings and the debarker head assembly, so that a precise adjustment can be made to determine the exact depth of the cut made by the blades of the debarker head assembly.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
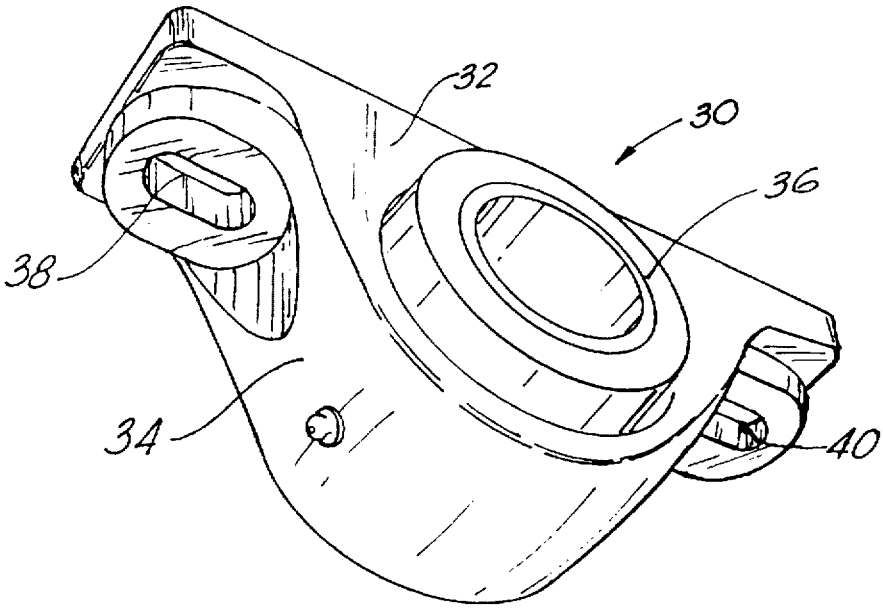
FIG. 1 PRIOR ART
FIG. 1 is an overall view of a pillow block bearing of the type currently utilized in the present state of the art.
Figure 2:
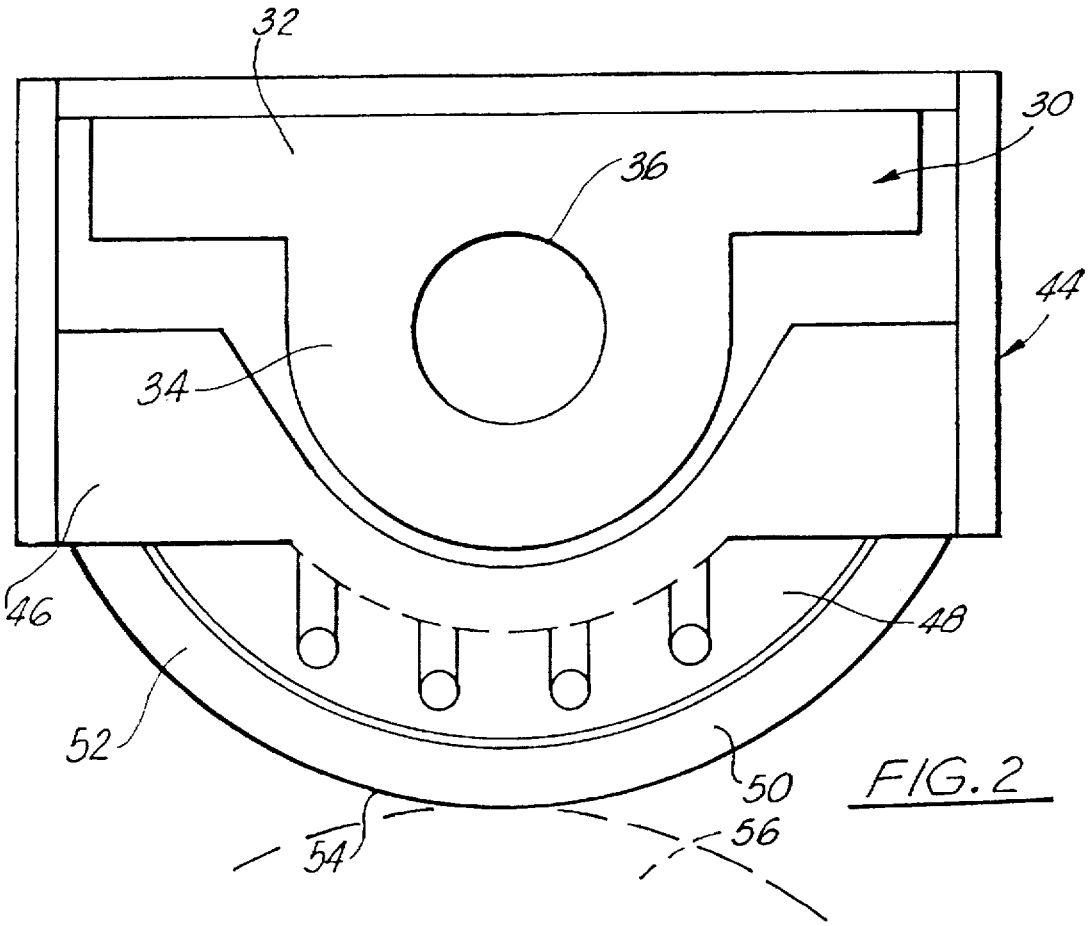
FIG. 2 depicts a side view of a pillow block bearing having a depth control bearing collar mounted thereupon for use on existing debarker head assemblies.
Figure 3:
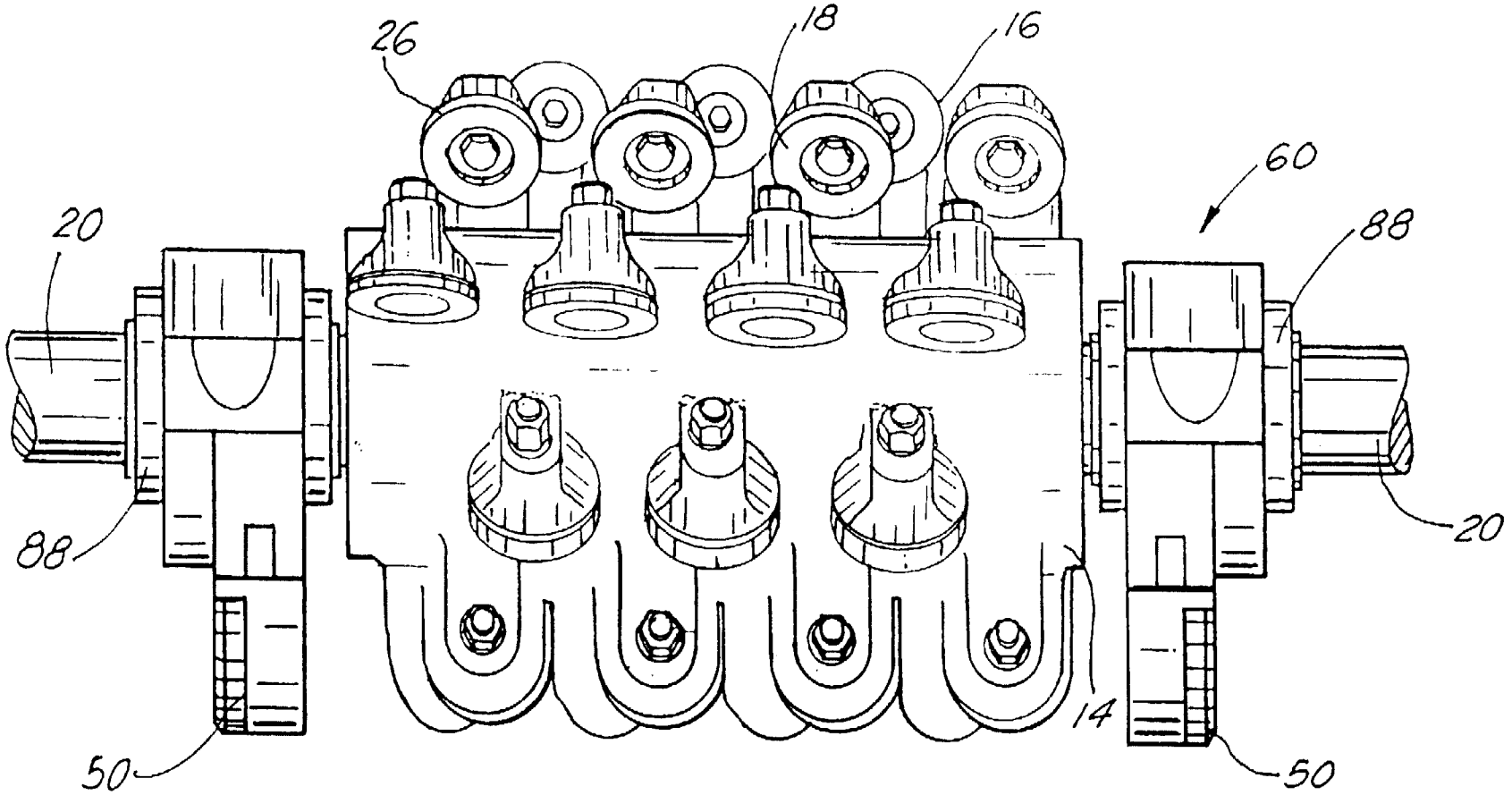
FIG. 3 is a front view of an overall debarker head assembly having the improved depth control bearings mounted at each end of the assembly.

FIGS. 2–6 illustrate the preferred embodiment of the apparatus of the present invention, with FIG. 1 illustrating the current state of the art which is designated as a pillow block bearing. Initially, in general, the apparatus of the present invention is illustrated by the numeral 10, for example, in FIG. 3. As illustrated in FIG. 3 debarking apparatus 10 would include a debarking head assembly 12 which would comprise a continuous cylindrical outer surface 14 including a plurality of mounting members 16 which would be utilized to mount a plurality of circular cutting blades 18 thereupon. In general, the debarking head assembly 12 would be rotated on a shaft 20 on a pair of bearings, one on each end of assembly 12. In use, the assembly 12 would be rotated at high speed with the blade surfaces 26 making contact with the bark of a log, in order to strip the bark from the log as was described earlier. The embodiment in FIG. 3 provides the assembly 12 mounted onto shaft 20 via a pair of depth control bearings, which will be discussed further.

Initially, reference is made to FIGS. 1 and 2 which illustrate an embodiment of the invention adapted to current bearing mountings. In the current state of the art, such debarking head assembly 12 are mountable onto shaft 20 via a pair of pillow block bearings 30 that is illustrated in FIG. 1. A standard pillow block bearing would normally include a bearing body 32 having a housing portion 34 for housing a rotatable bearing assembly 36 which would be freely rotatable so that when shaft member 20 is positioned there through, the bearing 36 enables the shaft to rotate at a high speed. The pillow block bearing 30 would be mountable via a pair of screw within slots 38, 40 to an assembly so as to allow the debarking apparatus to operate.

FIGS. 2–6 illustrate an improvement which has been incorporated into a debarking head assembly 12, which greatly improves the ability to measure the amount of bark that is stripped from a log during the debarking process. This system incorporates several embodiments as will be discussed at this time.

Turning to FIG. 2, there is illustrated in side view a rendering of a standard pillow block bearing 30 of the type as was discussed in reference to FIG. 1. The components of the bearing body 32, the housing 34 with the bearing assembly 36 mounted therein for rotation of the shaft 20. When such an assembly is in place, the improvement on a debarking head assembly 12 can be mounted there upon for use with the existing pillow block bearing 30. As illustrated in the Figures, there is illustrated a depth control bearing collar 44 which incorporates a bearing collar body 46 having a lower arcuate portion 48 which has mounted there upon an adjustable depth control shoe 50. The depth control bearing collar 44 would be mountable as illustrated over the existing pillow block bearing 30 and would utilize the same bearing assembly 36 of the pillow block bearing. Turning to the most important feature is the adjustable depth control shoe 50.

As is illustrated, the depth control shoe 50 includes an arcuate body portion 52 having a lower surface 54 which would make contact with a surface of a log 56 as shown in phantom view in FIG. 2 and will be discussed further in relation to other figures. FIG. 2 merely illustrates the manner in which this particular embodiment can be utilized with an existing pillow block bearing 30 and is easily mountable onto the central shaft 20, as was previously identified. For this particular embodiment, the depth control bearing collars are easily slidably engaged onto the central shaft 20, so that the improved collars may be positioned on any existing debarker head 12 as such of those manufactured by H.M.C., Precision, Fulgham, Mellot, Linga and other debarking machines.

Figure 4:
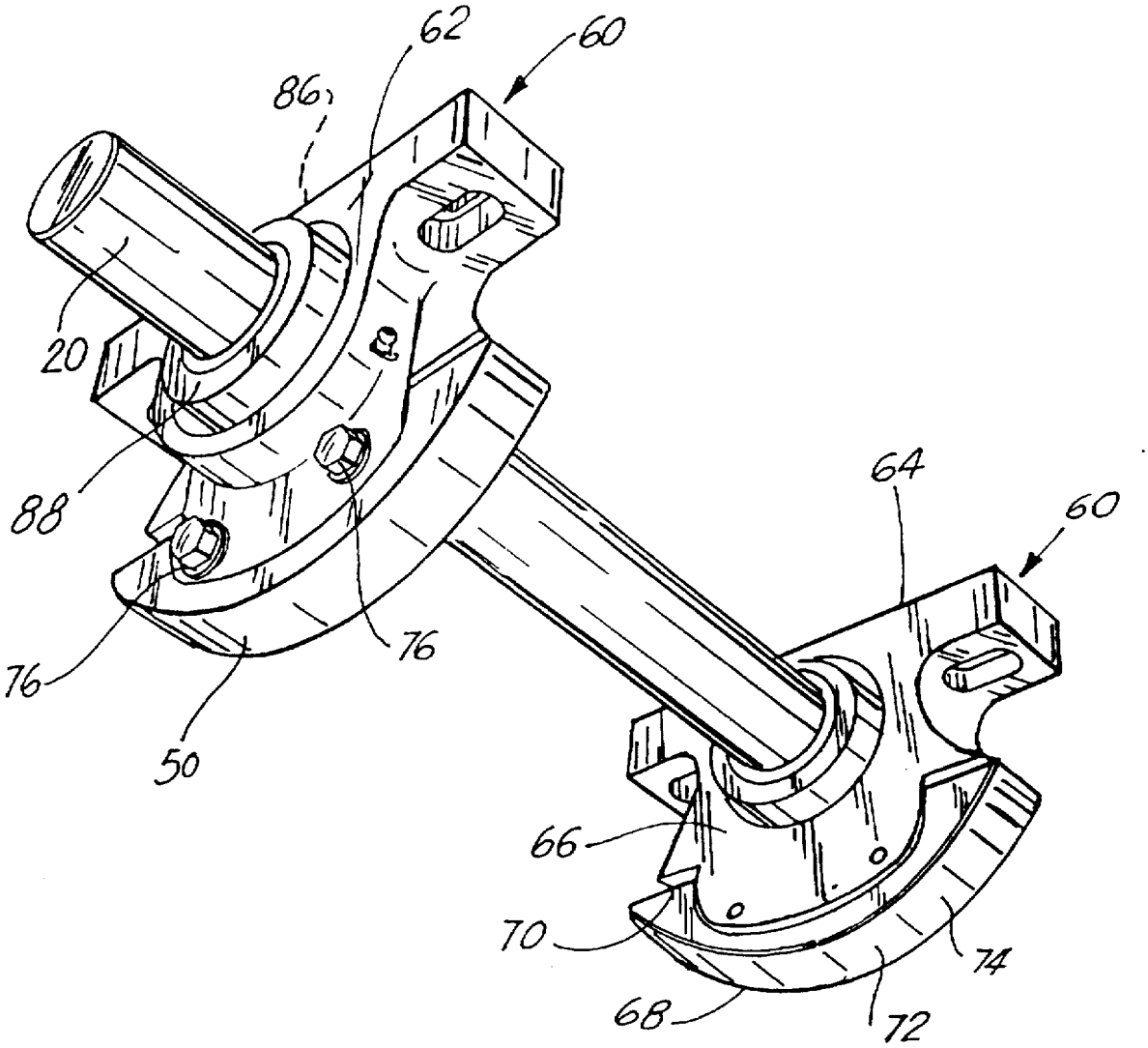
FIG. 4 is an overall perspective view of a pair of depth control bearings which would be mountable on both ends of an existing debarker head assembly.
Figure 6:
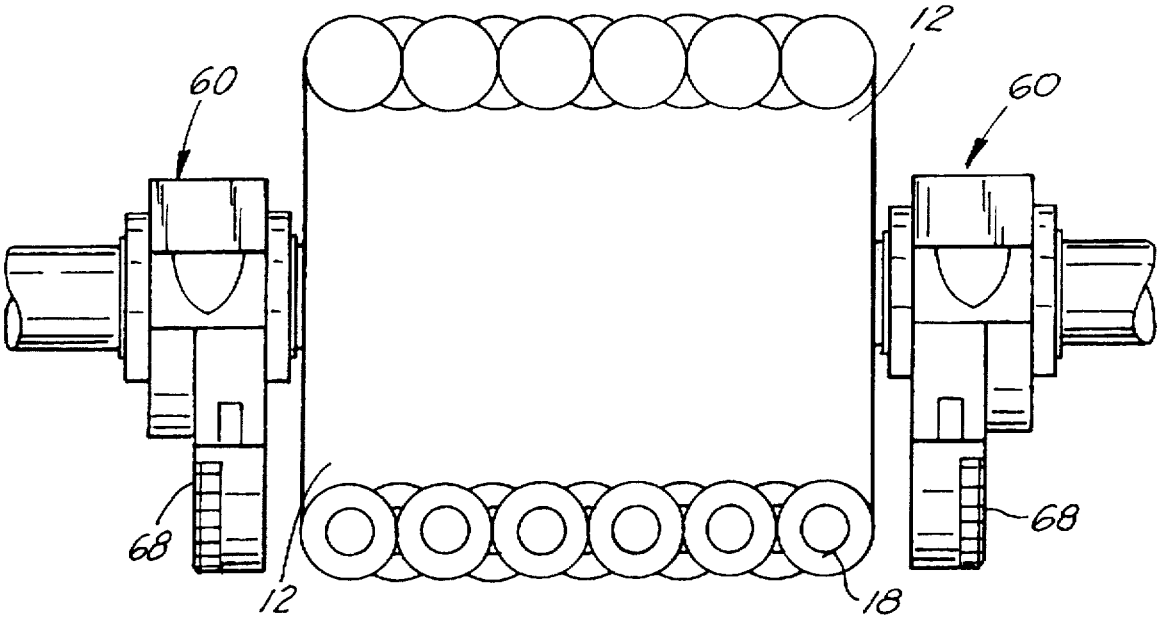
FIG. 6 illustrates a front view of the depth control bearings in place on either end of an existing debarker head assembly illustrating the depth control feature of the system.
Figure 5:
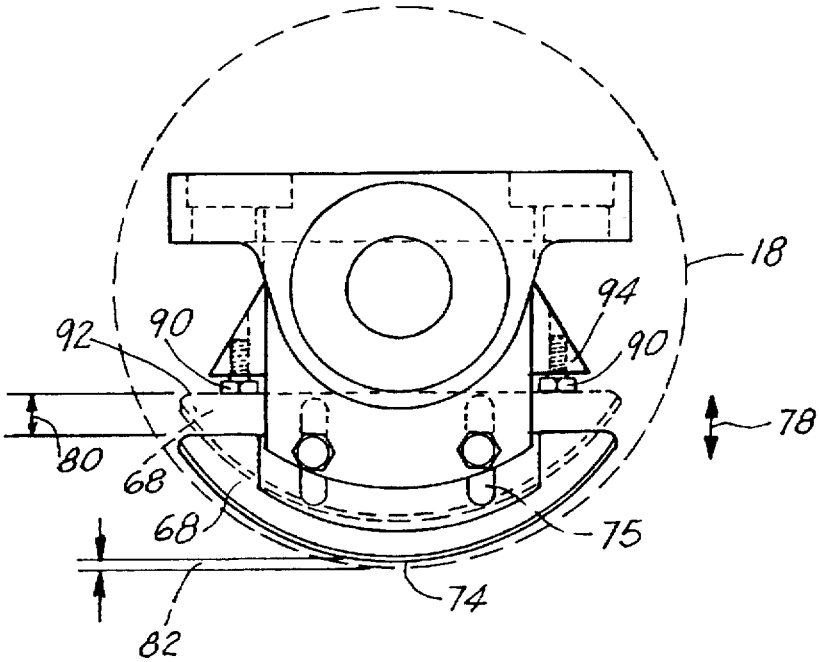
FIG. 5 illustrates a side view of an improved depth control bearing illustrating the adjustability of the shoe component thereof.

FIGS. 3–6 illustrate the improved embodiment of the present invention as would be utilized on newly developed debarking shoe assemblies which would not utilize a pillow block bearing, but would utilize what is termed a depth control bearing in its place. Turning first to FIGS. 4–6, there is illustrated the new depth control bearing 60 in place on shaft 20. For example, on FIGS. 3 and 6, the depth control bearings 60 are mountable on each ends of the debarker head assembly 12 which is the type having the plurality of blades 18 rotatable on the central cylinder 12, during the debarking process. In this improved embodiment, each of the depth control bearings 60 would include an upper bearing body 62 mountable via a pair of bolts which would insert through openings 64 to an upper assembly for mounting the debarking head assembly there upon. The depth control bearing 60 would further include a lower body portion 66 where upon there is mounted an adjustable depth control shoe 50. Adjustable depth control shoe 50, as seen in the Figures, as was described earlier, includes an upper mounting body portion 52 and a lower depth control arcuate shoe portion 53, the portion 53 including a lower surface 74 which would make contact with the outer bark of a log being debarked. As seen in the Figures, each of the arcuate shoes 50 would include a pair of elongated slots 75 (as seen in FIG. 5), which would engage a pair of bolt members 76 threadably engaged into the lower body 66 of the depth control bearing 60. The slots 75 would allow the shoe member 50 to slide in the direction of arrow 78 as seen in FIG. 5, so as to control the depth of the shoe 50 during the debarking process.

For example, in FIG. 5 there is shown in full view the depth control shoe 50 in a first lower position and in phantom view shoe 50 has been moved upward over a distance shown by arrow 80 to a higher position which would determine therefore the depth of the cut. Also seen in FIGS. 5 and 6 is the fact that in phantom view there is seen the outermost limit of the blades 18 making their cut during the rotation of the debarker head assembly 12, with the lower surface 74 of the shoe 50 being slightly higher as shown by a gap 82 in FIG. 5. Therefore, the gap 82 would determine the depth of the cut being made by the blades 18 into the bark of the log 56.

For purposes of mounting, the depth control bearings would include an opening 86 wherein a tapered bearing assembly 88 would be engaged onto shaft 20, and each of the depth control bearings 60 would be mounted thereupon. Once in place, on either side of the debarking head assembly 12 as illustrated in FIG. 6, then the adjustable shoes 68 could be properly adjusted to the proper depth as seen in FIG. 6, and the assembly could begin its operation. It should be noted further that for example in FIG. 5, in order to properly control the depth of the shoe as it is in place, there is further included a pair of vertical stop screws 90 which are engaged into the upper body portions 62 of the bearing 60, so that an upper surface 92 would make contact with the head 94 of each of the bolts 90, and the shoe 50 could go no further up than its contact with the head 94. Therefore, in order to properly maintain the depth of the shoe 50, bolt 90 could simply be threadably engaged or disengaged as the case may be, to a precise distance so that the shoe 68 is moved vertically as needed.

For purposes of mounting, it should be made clear that the improved depth control bearing collars 60 are engagable onto the shaft 20 and would be mountable in place of the type E pillow block bearing which is commonly found on debarking apparatuses, as seen in FIG. 1. As was stated earlier, each of the depth control bearings 60 would be mountable on each side of the debarker head assembly 12 and would be engaged in place so that the shaft 20 would rotate on the bearings 88, yet the adjustable shoes would be movable in relation to the fixed location of the depth control bearing 60, so as to adjust the depth of the cut. The mounting would be quite simple in that the bearings would mount with the same bolts and nuts as would be utilized with the standard pillow block bearings for ease of installation. The cutting teeth would be carbon tipped and rounded indexable cutters, and the construction of the apparatus would be completely steel with a replaceable alloy shaft. Any teeth could be replaceable easily without removing the head of the cutter from the apparatus itself.

It should be noted that the bearing with the depth control device is quite similar to the standard type E pillow block bearing in that there is a bearing housing which would be mountable and there would be included a bearing insert as is a standard pillow block bearing, wherein the shaft would rotate. The improvement as was stated earlier, includes the use of the support member extending from the housing, and including the bolts which engage within the slots of the depth control shoes so as to control the depth of the cutters during operation.

The foregoing embodiments are presented by way of example only; the scope of the present invention is to be limited only by the following claims.

I claim:

1. An improved debarker head assembly, comprising:

a. an assembly body having a plurality of cutting blades, the assembly body rotatable around a central shaft;

b. a pair of depth control bearings, each depth control bearing mountable on each end of the assembly body, and defining a means to rotate the assembly body around the shaft;

c. a depth control shoe, positioned on each depth control bearing, the depth control shoe adjustable along a vertical plane, to define a means for controlling the depth of a cut into the bark of a log by the cutting blades.

2. The assembly in claim 1, wherein the depth control bearings further comprise a bearing member positionable on the shaft for supporting the assembly body.

3. The assembly in claim 1, wherein the depth control shoe further comprises an arcuate lower surface which contacts the bark of the log and defines the depth of cut to be made by the cutting blades.

4. The assembly in claim 1, wherein the depth control shoe further comprises a pair of slots for receiving a bolt so that the shoe is moveable vertically to determine the depth of the cut.

5. The assembly in claim 1, further comprising a pair of stop bolts which define a means to prevent the depth control shoe from moving along the vertical plane, beyond the point the shoe has been positioned in place.

6. The assembly in claim 1, wherein the lower surface of the depth control shoe is slightly higher than the cutting edge of the cutting members, the vertical difference defining the depth of the cut-into the bark by the cutting blades.

7. An improved debarker head assembly, of the type including a rotatable debarker head mounted on a central shaft, and having a plurality of cutting blades for cutting into the bark of a log as the head is rotated, the improvement comprising:

a. a pair of depth control bearings, each depth control bearing mountable on each end of the assembly body, and defining a bearing means to rotate the assembly body around the shaft; and b. a depth control shoe, positioned on each depth control bearing, each depth control shoe adjustable along a vertical plane, to define a means for controlling the depth of a cut into the bark of a log by the cutting blades when the depth control shoe makes contact with the bark of the log.

8. The assembly in claim 7, wherein the depth control bearings further comprise bearing members positionable on the shaft for supporting the assembly body.

9. The assembly in claim 7, wherein each depth control shoe further comprises an arcuate lower surface which contacts the bark of the log and defines the depth of cut to be made by the cutting blades as the distance between the depth of the cutting shoe and the depth of cutting blade edge.

10. The assembly in claim 7, wherein the depth control shoe further comprises a pair of slots for receiving a bolt so that the shoe is moveable vertically to determine the depth of the cut to be made by the cutting blades.

11. The assembly in claim 7, further comprising a pair of stop bolts mounted in the assembly body, for preventing the depth control shoe from moving along the vertical plane, beyond the point the shoe has been positioned in place.

12. The assembly in claim 7, wherein the lower surface of the depth control shoe is slightly higher than the cutting edge of the cutting members, the vertical difference defining the depth of the cut into the bark by the cutting blades.

13. An improved debarker head assembly, comprising:

a. a plurality of cutting blades rotatable about a central shaft;

b. a pair of pillow block bearings supporting the rotating cutting blades around the central shaft;

c. a depth control bearing collar positionable on each of the pillow block bearings; and d. a depth control shoe, positioned on each depth control bearing collar, the depth control shoe vertically adjustable to define a means for controlling the depth into the bark of a log the cutting blades cut to debark the log.

14. The assembly in claim 13, wherein the depth control shoe further comprises an arcuate lower surface which contacts the bark of the log and defines the depth of cut to be made by the cutting blades.

15. The assembly in claim 13, wherein the depth control shoe further comprises a pair of slots for receiving a bolt so that the shoe is moveable vertically to determine the depth of the cut.

16. The assembly in claim 13, further comprising a pair of stop bolts which define a means to prevent the depth control shoe from moving along the vertical plane, beyond the point the shoe has been positioned in place.

17. The assembly in claim 13, wherein the lower surface of the depth control shoe is slightly higher than the cutting edge of the cutting members, the vertical difference defining the depth of the cut into the tree bark by the cutting blades.

* * * * *